US007714716B2

(12) United States Patent
DiPoala

(10) Patent No.: US 7,714,716 B2
(45) Date of Patent: May 11, 2010

(54) CODED SECURITY SENSOR FOR A DOOR

(75) Inventor: William S. DiPoala, Fairport, NY (US)

(73) Assignee: Robert Bosch GmbH, Stuttgart (DE)

( * ) Notice: Subject to any disclaimer, the term of this patent is extended or adjusted under 35 U.S.C. 154(b) by 319 days.

(21) Appl. No.: 11/782,674

(22) Filed: Jul. 25, 2007

(65) Prior Publication Data

US 2009/0027199 A1 Jan. 29, 2009

(51) Int. Cl.
*G08B 13/08* (2006.01)

(52) U.S. Cl. ..... 340/545.1; 340/545.2; 340/545.3

(58) Field of Classification Search ..... 340/545.1, 340/545.2, 545.3, 545.4, 551, 552, 555, 556, 340/557, 547, 553; 250/221, 222
See application file for complete search history.

(56) References Cited

U.S. PATENT DOCUMENTS

| | | | | |
|---|---|---|---|---|
| 5,912,619 | A * | 6/1999 | Vogt | 340/545.1 |
| 5,936,522 | A * | 8/1999 | Vogt | 340/545.1 |
| 6,310,548 | B1 * | 10/2001 | Stephens et al. | 340/540 |
| 6,751,909 | B2 * | 6/2004 | Ranaudo | 49/506 |
| 7,491,926 | B1 * | 2/2009 | Anderson et al. | 250/221 |
| 2007/0223210 | A1 * | 9/2007 | Schubert | 362/94 |

* cited by examiner

*Primary Examiner*—Van T. Trieu
(74) *Attorney, Agent, or Firm*—Sarah L. Taylor, Esq.

(57) ABSTRACT

A method of detecting a position of a movable building structure includes mounting a readable code in association with a first surface of the movable building structure or with a second surface of a second structure. A code reader is mounted in association with the other of the first surface and the second surface. The readable code is read by the code reader to thereby verify that the first surface of the movable building structure is disposed in opposition to the second surface of the second structure.

27 Claims, 5 Drawing Sheets

CODED SECURITY SENSOR FOR A DOOR

BACKGROUND OF THE INVENTION

1. Field of the Invention

The present invention relates to surveillance system sensors, and, more particularly, to surveillance system sensors for detecting the opening of a door or window.

2. Description of the Related Art

Surveillance systems, also known as security systems, are known to include door sensors for monitoring the opening and closing of a door. Door sensors are known to be in the form of a pushbutton that is held in a depressed state by the door when the door is in a closed position. When opening, the door moves away from the pushbutton, thereby releasing the pushbutton from the depressed state. A controller monitors the state of the pushbutton, and may issue an alarm signal if the door is opened without authorization. A problem with this type of sensor is that an intruder can defeat it by inserting a thin object, such as a piece of sheet metal, between the door and the pushbutton such that the object holds the pushbutton in a depressed state when the door is opened. Thus, the controller cannot detect that the door has been opened.

Another type of door sensor is the magnetic reed switch type that includes a reed switch sensor mounted on the door frame. The sensor detects and monitors the presence of a magnet that is mounted on the door at a location that is adjacent to the sensor when the door is in the closed position. Thus, the magnet may be detected by the sensor only when the door is closed. A problem with this type of sensor is that it too may be defeated by an intruder. For example, the intruder may attach another magnet adjacent to the reed switch sensor before opening the door such that the sensor's detection of the presence of a magnet is uninterrupted. Here too, the sensor, and a controller connected to the sensor, cannot detect that the door has been opened.

What is needed in the art is a door/window sensor that cannot be easily defeated by an intruder and that can be incorporated into a security system.

SUMMARY OF THE INVENTION

The present invention provides a door sensor having a first part that may be mounted on a door frame or on a door, and that includes an optical or magnetic code reader. A second part of the door sensor may be mounted on the other one of the door frame and the door, and includes a multi-bit code which may be read by the code reader.

The invention comprises, in one form thereof, a method of detecting a position of a movable building structure. A readable code is mounted in association with a first surface of the movable building structure or with a second surface of a second structure. A code reader is mounted in association with the other of the first surface and the second surface. The readable code is read by the code reader to thereby verify that the first surface of the movable building structure is disposed in opposition to the second surface of the second structure.

The invention comprises, in another form thereof, a security assembly including a first building structure at least partially defining a building opening. The first building structure has a first surface. A movable building structure is movable between a closed position in which the movable building structure covers the opening and an open position in which the movable building structure uncovers the opening. The movable building structure has a perimeter with a second surface disposed in opposition to the first surface when the movable building structure is in the closed position. A sensor apparatus includes an optical scanner mounted in the first surface or the second surface. The optical scanner scans a pattern printed in association with the other of the first surface and the second surface and produces a signal dependent upon the pattern. A decoder is in communication with the scanner. The decoder receives the signal and verifies therefrom that the movable building structure is disposed in opposition to the first building structure.

The invention comprises, in yet another form thereof, a security assembly including a first building structure at least partially defining a building opening. The first building structure has a first surface. A movable building structure is movable between a closed position in which the movable building structure covers the opening and an open position in which the movable building structure uncovers the opening. The movable building structure has a perimeter with a second surface disposed in opposition to the first surface when the movable building structure is in the closed position. A sensor apparatus includes a plurality of magnetic field sensors mounted in the first surface or the second surface. Each of the sensors senses whether a respective magnetic element is disposed opposite the sensor on the other of the first surface and the second surface, and produces a signal indicative thereof. A decoder device, which is in communication with the sensors, receives the signals and verifies therefrom that the movable building structure is disposed in opposition to the first building structure.

The invention comprises, in still another form thereof, a security assembly including a first object having a first surface and a second object having a second surface. The second object is movable between a first position in which the first surface is adjacent to the second surface and a second position in which the first surface is non-adjacent to the second surface. A sensor apparatus includes a plurality of magnetic field sensors mounted in the first surface or the second surface. Each of the sensors senses whether a respective magnetic element is disposed opposite the sensor on the other of the first surface and the second surface, and produces a signal indicative thereof. A decoder device is in communication with the sensors. The decoder device receives the signals and determines therefrom whether the second object is in the first position or the second position.

An advantage of the present invention is that it is difficult for a would-be intruder to defeat. Because the code or pattern read by the sensor is unique and is not visible, it is difficult for a would-be intruder to replicate.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
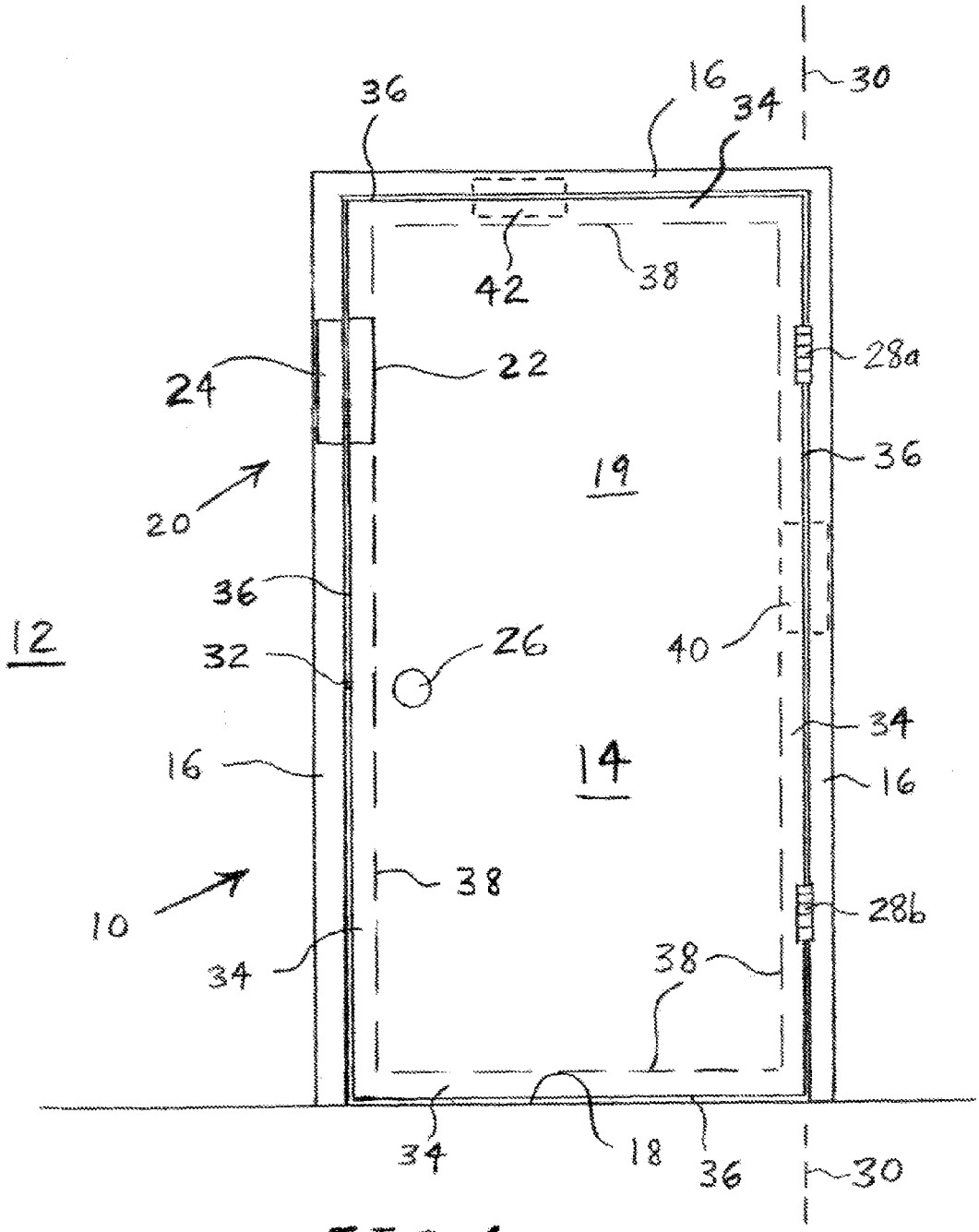
FIG. 1 is a plan view of one embodiment of a door assembly including a security sensor apparatus of the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Referring now to the drawings and particularly to FIG. 1, there is shown one embodiment of a security assembly, in particular a door assembly 10, of the present invention for incorporation into a structure 12 such as a building, or, more particularly, a wall of a building. Door assembly 10 includes a movable building structure in the form of a door 14, which is surrounded by portions of structure 12, such as a door frame 16 and a floor surface 18. Door frame 16 and a floor surface 18 define a building opening 19 in the form of a doorway that door 14 covers when door 14 is in a closed position and that door 14 uncovers when door 14 is in an open position. A security sensor apparatus 20 is mounted partially within door 14 and partially within door frame 16. Security sensor apparatus 20 includes a readable code arrangement 22 and a code reader 24. Readable code arrangement 22 and code reader 24 may be mounted in opposing locations within door 14 and door frame 16, respectively.

Door 14 may be opened by manually grasping knob 26 and rotating door 14 about hinges 28*a,* 28*b,* i.e., about an axis 30 defined by hinges 28, as is well known. If door 14 is locked, i.e., if a latch 32 of door 14 is locked in a coupled state with frame 16, an intruder may nevertheless open door 14 by breaking hinges 28 and/or latch 32 away from frame 16, thereby allowing door 14 to be moved away from frame 16, as is also well known.

Readable code arrangement 22 may be mounted in or on a surface of door 14 at a location that is along a perimeter 34 of door 14. Perimeter 34 may be defined as an outer section of door 14 that is between outer edges 36 of door 14 and locations indicated generally by dashed line 38. Readable code arrangement 22 is shown mounted in a surface of perimeter 34 that is disposed opposite from hinges 28. However, readable code arrangement 22 could alternatively be mounted in a surface of perimeter 34 that is adjacent to hinges 28, as indicated at 40. Moreover, readable code arrangement 22 could be mounted not in a jamb, but rather in a surface of an upper portion of perimeter 34, as indicated at 42.

Regardless of in which location in the surface of perimeter 34 readable code arrangement 22 is mounted, code reader 24 may be mounted in a surface of door frame 16 at a location that opposes the mounting location of readable code arrangement 22.

Figure 2:
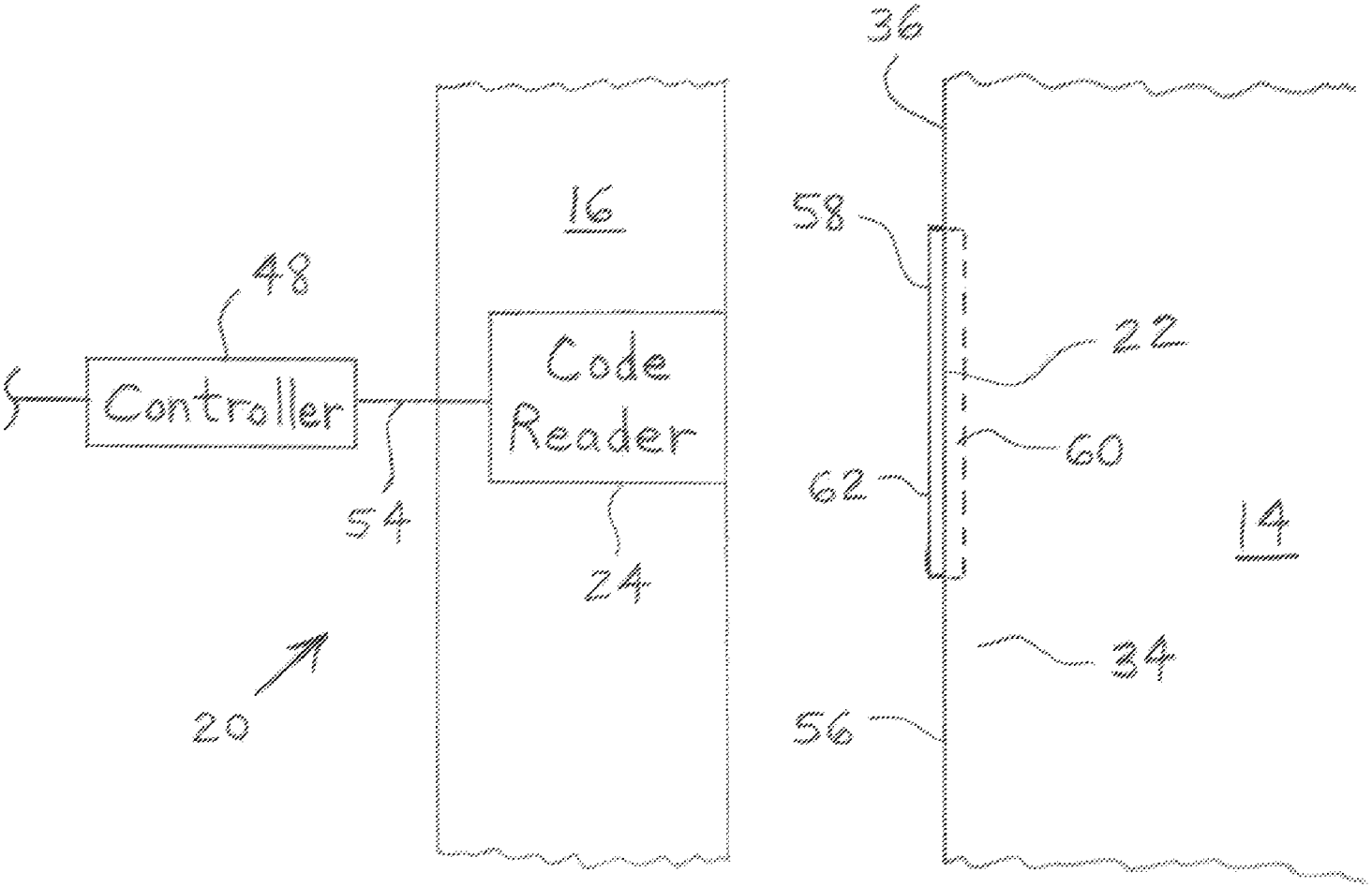
FIG. 2 is a block diagram of one embodiment of the sensor apparatus of FIG. 1.

As shown in FIG. 2, code reader 24 may be electrically connected to a controller 48, such as through line 54. Controller 48 may be in the form of a decoder that receives on line 54 a signal from code reader 24 that is indicative of a code read by code reader 24. Controller 48 may compare the code read by code reader 24 to an expected code which may be pre-programmed into controller 48. If controller 48 determines that there is a sufficient match between the code read by code reader 24 and the expected code, then controller 48 may thereby verify that door 14 is disposed in opposition to, or adjacent to, door frame 16, i.e., that door 14 is in the closed position.

Although controller 48 is shown in FIG. 2 as being disposed outside of door frame 16, controller 48 may alternatively be disposed within door frame 16. In a particular embodiment, controller 48 is disposed within a control panel (not shown) or within some other centralized device that is capable of causing some type of alarm signal or tamper signal to be issued in response to controller 48 determining that door 14 has been opened without authorization. A determination that door 14 has been opened may be made by controller 48 as a result of code reader 24 no longer reading a code that matches the expected code that may be programmed into controller 48. Code reader 24 may attempt to read the code continuously or periodically with a frequency that may depend upon the requirements of a particular application.

Code reader 24 may be in the form of a bar code reader that reads a readable code arrangement 22 in the form of a bar code that is printed in association with a surface 56 of outer edge 36 of door 14. The bar code may be printed directly on surface 56, or may be printed on a label or sticker that is affixed to surface 56, for example.

Code reader 24 may scan the code on surface 56 by using light in the infrared range. In order to prevent a bystander from visually reading the code on surface 56 and replicating the code on a portable surface for use in defeating the system, the code may be covered by a substrate 58 that is visually opaque. Substrate 58 may also be transparent to infrared light in order to allow code reader 24 to read the code through substrate 58. Substrate 58 may be attached to surface 56 via adhesive or any conventional fastening devices, such as screws (not shown). Code reader 24 may include an emitter (not shown) that produces optical energy having a wavelength in the infrared range. Code reader 24 may also include a photodiode (not shown) or any other type of optical receiver that is capable of detecting optical energy of the infrared frequency range.

In order to prevent a would-be intruder from removing substrate 58 so that he may visually read the code, substrate 58 and the code may be configured such that attempting to remove substrate 58 from surface 56 results in the code becoming unreadable. For example, the code could be laminated or molded underneath or into substrate 58. Substrate 58 may be designed to break, disintegrate, or otherwise self-destruct along with the code in the event that an attempt is made to remove substrate 58 from surface 56. Particularly, the code could be formed of thin, fragile material that is molded into substrate 58 such that the code breaks apart and becomes unreadable if substrate 58 is tampered with.

As shown in FIG. 2, the code is deposited on a substantially planar surface 56, and substrate 58 is attached to the planar surface 56. However, in another embodiment, surface 56 is provided with a recess 60, indicated in dashed lines in FIG. 2, sized to receive substrate 58 therein. Recess 60 may be provided with a depth such that an outer surface 62 of substrate 58 is coplanar with the remainder of surface 56 that is not included in recess 60. Such a configuration has the advantages of substrate 58 being more difficult to remove from door 14, and of outer surface 62 and surface 56 conjointly forming a continuous smooth surface that is less subject to being damaged and causing damage.

It is to be understood that when code reader 24 is in the form of an optical scanner, the code that is read is not limited to a bar code or any type of binary code. It is possible within the scope of the invention for code reader 24 to optically read or recognize a unique pattern that is printed or otherwise deposited in association with surface 56. Code reader 24 may read or recognize the pattern digitally or through other techniques.

Figure 3:
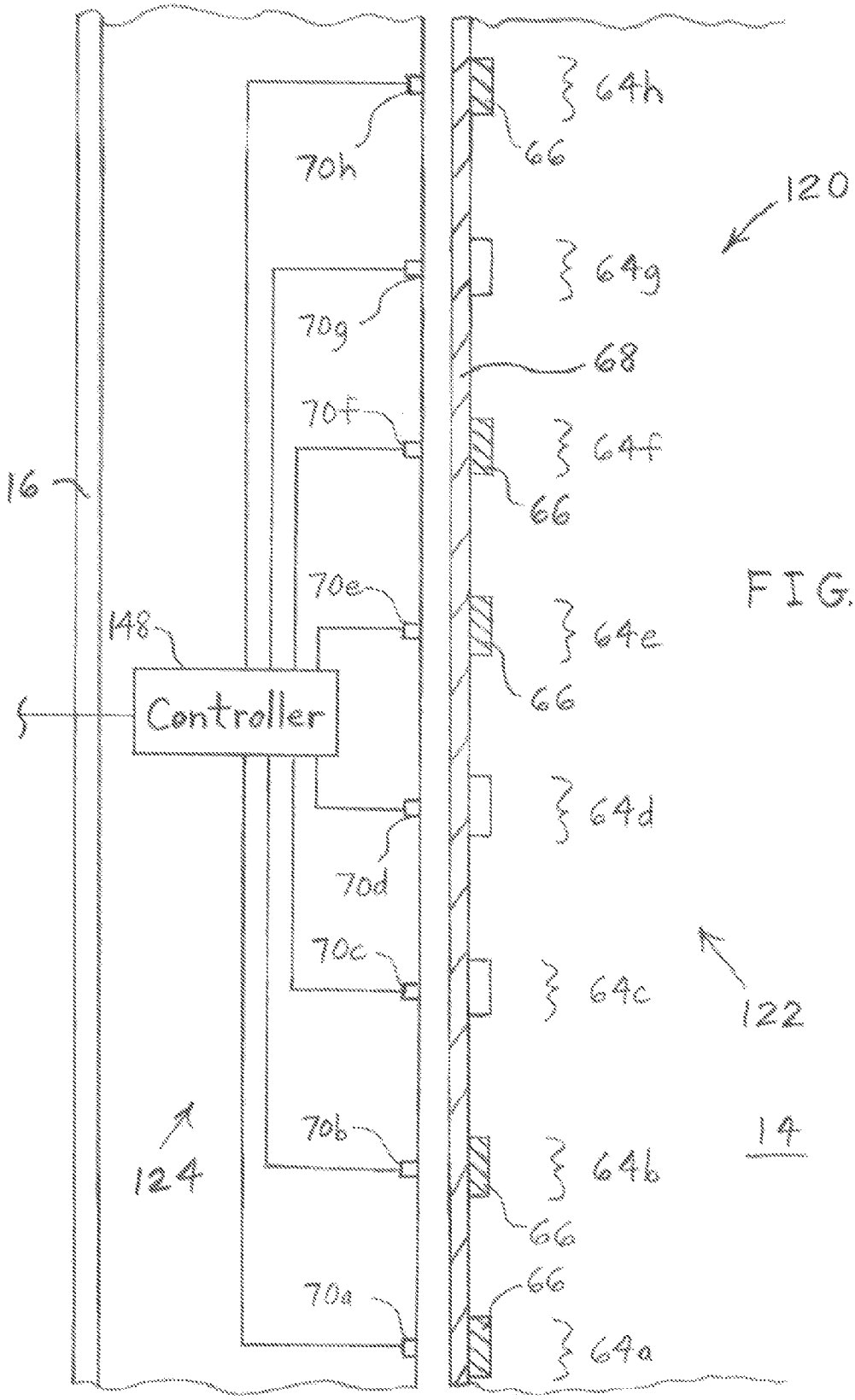
FIG. 3 is a block diagram of another embodiment of the sensor apparatus of FIG. 1.

FIG. 3 illustrates another embodiment of a sensor apparatus 120 suitable for use in the application depicted in FIG. 1. In this embodiment, a readable code arrangement 122 is in the form of locations 64*a-h* each having a respective presence or absence of a magnet 66 therein. In the example shown, locations 64*a, b, e, f* and *h* each have a respective magnet 66 present therein; and a magnet is absent in each of locations 64*c, d* and *g*. Considering location 64*a* to represent a least significant bit, and location 64*h* to represent a most significant bit, the placement of the five magnets 66 in FIG. 3 may be represented by the binary code 1011 0011. A visually opaque but magnetically transparent shield 68 may cover each of locations 64 in order to prevent a would-be intruder from seeing in which locations 64 that magnets 66 are present.

In the embodiment of FIG. 3, a code reader 124 is in the form of magnetic field sensors 70*a-h* that are electrically connected to a decoder device in the form of a controller 148. Magnetic field sensors 70 may be in the form of reed switches that each sense whether a magnet 66 is disposed opposite the sensor, and that each produce a signal indicative of whether the magnet is sensed. Each of the signals may be transmitted by the respective reed switches to controller 148.

During use, after installation of security sensor apparatus 20 or 120, door 14 is moved to a closed position and sensor apparatus 20, 120 is armed, such as by a user via a control panel (not shown). In the armed state, sensor apparatus 20, 120 may continually or periodically monitor the status of door 14. The user may disarm sensor apparatus 20, 120 by entering a security code into the control panel, for example, perhaps within a grace time period after door 14 is opened. In the disarmed state, sensor apparatus 20, 120 may no longer monitor door 14, or may refrain from issuing an alarm signal or tamper signal if door 14 is opened.

In the armed state, if door 14 is opened, such as by an intruder, then code reader 24 or 124 is no longer in position to read the readable code of arrangement 22, 122. A determination that door 14 has been opened may be made by controller 48 or 148 based upon a code reader 24, 124 no longer reading a code that matches an expected code that may be pre-programmed into controller 48, 148. That is, controller 48, 148 compares a code that is read (or not read) by code reader 24, 124 to the expected code in order to determine whether there is a sufficient match between the two. The read code and the expected code may both be binary. Controller 48, 148 may issue an alarm signal in response to the determination that door 14 has been opened without authorization.

If controller 48, 148 determines that some code is being read by code reader 24, 124, but it is not the expected code, then controller 48, 148 may conclude that someone may be tampering with sensor apparatus 20, 120. That is, then controller 48, 148 may conclude that someone may be unsuccessfully trying to defeat sensor apparatus 20, 120 by attempting to place a counterfeit readable code arrangement such that it may be read by code reader 24, 124. Controller 48, 148 may then issue a tamper signal, which may be, for example, in the form of a beeping sound that indicates to the user that investigation or maintenance may be needed.

The present invention has been described herein as being applied to detecting the opening and closing of a hinged door that swings between an open position and a closed position. However, the present invention may be used to monitor any movable building structure that is movable between a closed position in which the movable building structure covers a building opening and an open position in which the movable building structure uncovers the building opening.

Figure 4:
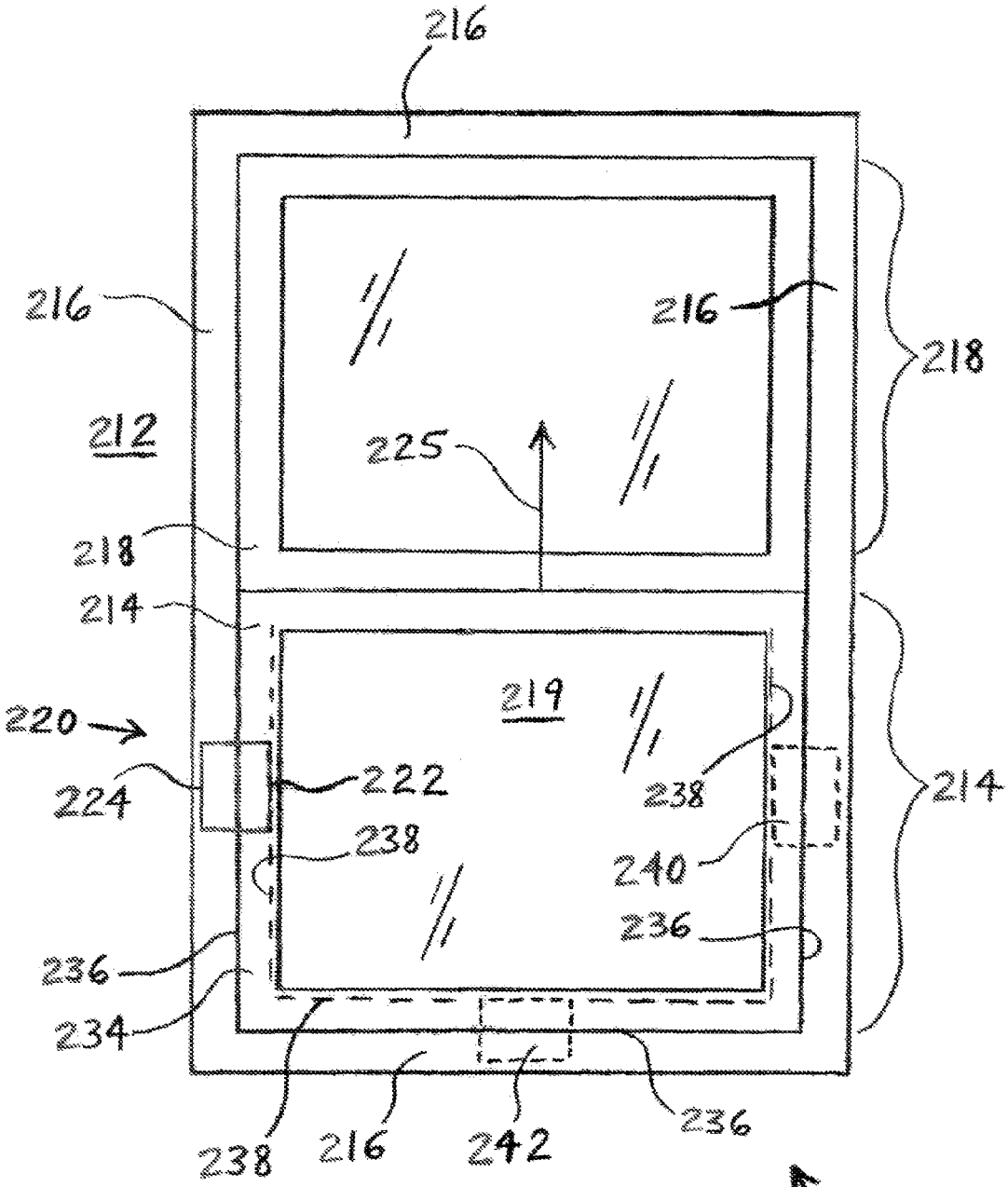
FIG. 4 is a plan view of one embodiment of a window assembly including a security sensor apparatus of the present invention.

In FIG. 4, there is shown another embodiment of a security assembly of the present invention in the form of a window assembly 210 for incorporation into a structure 212 such as a building, or, more particularly, a wall of a building. Window assembly 210 includes a movable building structure in the form of a movable window sash 214, which is surrounded by portions of structure 212, such as a wall, a window frame 216 and a fixed window sash 218. Window frame 216 and a fixed window sash 218 define a building opening 219 in the form of a window opening that sash 214 covers when sash 214 is in a closed position and that sash 214 uncovers when sash 214 is in an open position. A security sensor apparatus 220 is mounted partially within sash 214 and partially within window frame 216. More particularly, sensor apparatus 220 includes a readable code arrangement 222 and a code reader 224 which may be mounted in opposing locations within sash 214 and window frame 216, respectively.

Sash 214 may be opened by manually grasping sash 214 and sliding sash 214 in an upward direction 225, as is well known. Imaginary planes defined by sashes 214, 218 may be parallel to each other and displaced from each other in a direction into the page of FIG. 4. To at least partially open sash 214, and thereby at least partially uncover opening 219, sash 214 may be slid in direction 225 in tracks (not shown) in frame 216 such that sash 214 at least partially overlaps sash 218 in a direction into the page of FIG. 4, as is also well known.

Readable code arrangement 222 may be mounted in a surface of sash 214 at a location that is along a perimeter 234 of sash 214. Perimeter 234 may be defined as an outer section of sash 214 that is between outer edges 236 of sash 214 and locations indicated generally by dashed line 238. Readable code arrangement 222 is shown mounted in a vertically-oriented surface of perimeter 234. However, readable code arrangement 222 could alternatively be mounted in the portion of the surface of perimeter 234 that is on the other end of sash 214, as indicated at 240. Moreover, readable code arrangement 222 could be mounted not in a vertically-oriented surface, but rather in a horizontally-oriented surface of perimeter 234 that is disposed opposite the window sill, as indicated at 242. Regardless of in which location in the surface of perimeter 234 readable code arrangement 222 is mounted, code reader 224 may be mounted in a surface of window frame 216 at a location that opposes the mounting location of readable code arrangement 222.

Figure 5:
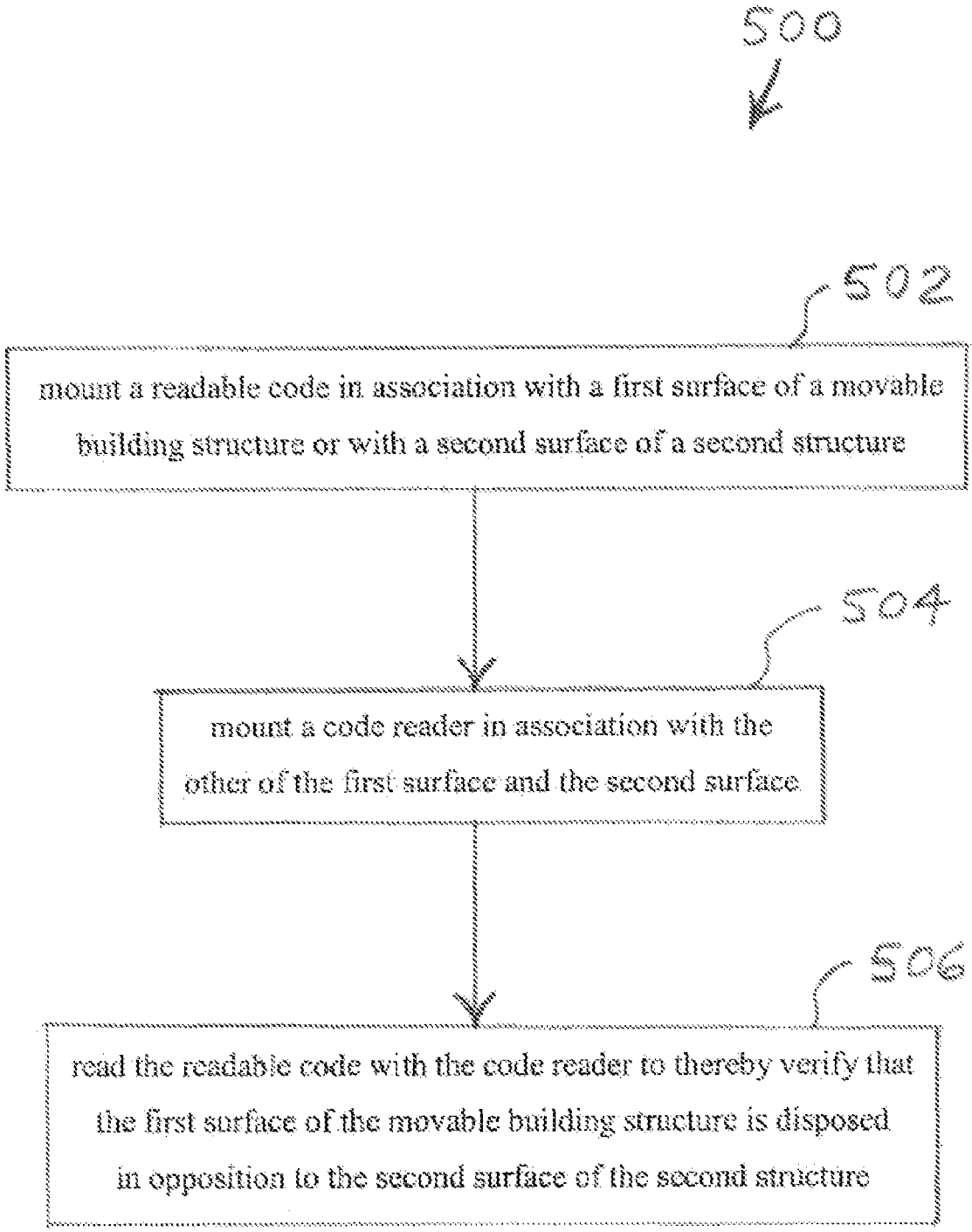
FIG. 5 is a flow chart of one embodiment of a method of the present invention for detecting a position of a movable building structure.

FIG. 5 illustrates one embodiment of a method 500 of the present invention for detecting a position of a movable building structure. In a first step 502, a readable code is mounted in association with a first surface of a movable building structure or with a second surface of a second structure. For example, a bar code may be mounted on a surface 56 of door 14, or may be mounted on a surface of door frame 16. As another example, magnets 66 may be mounted in a subset of locations 64 on the surface of door 14, or may be mounted in a subset of locations on a surface of door frame 16. In a next step 504, a code reader is mounted in association with the other of the first surface and the second surface. In particular, if a bar code or magnets 66 are mounted on a surface 56 of door 14, then a bar code scanner or magnetic field sensors 70 may be mounted on a surface of door frame 16. Alternatively, if a bar code or magnets 66 are mounted on a surface of door frame 16, then a bar code scanner or magnetic field sensors may be mounted on a surface 56 of door 14. In final step 506, the readable code is read by the code reader to thereby verify that the first surface of the movable building structure is disposed in opposition to the second surface of the second structure. For example, the bar code may be read by the bar code scanner, or the locations of magnets 66 may be detected by magnetic field sensors 70, to thereby verify that door 14 is disposed in opposition to door frame 16, e.g., that door 14 is in the closed position. Although method 500 has been described above as applying to a door, it is to be understood that method 500 is equally applicable to a window.

The present invention has been primarily described herein in connection with sensing the opening of a hinged door that swings between an open position and a closed position. However, it is to be understood that the features of the present invention described herein may be equally applicable to sensing the opening of any movable building structure (such as a window or a sliding door) that translates between an open position and a closed position. Further, the features of the present invention described herein may be applicable to sensing the movement of any object, including an object that is not part of a building.

The present invention has been described herein as including a readable code arrangement and a code reader mounted at opposing locations within the door and the door frame, respectively. However, it is to be understood that it is within the scope of the present invention for the readable code arrangement to be mounted within the door frame and the code reader to be mounted within the door. Moreover, it is also within the scope of the present invention for one of the readable code arrangement and the code reader to be mounted within a bottom edge of the door and the other to be mounted at an opposing location within the floor surface.

The readable code arrangement of the present invention has been described herein as being mounted in an outer edge of a door so as to be sensed by a code reader that is opposingly positioned in the door frame. However, it is also possible for the readable code arrangement to be mounted within or on one of the two large opposite surfaces of the door, albeit along the perimeter of the door such that the readable code arrangement is covered, when the door is closed, by a portion of the door frame that is parallel to the plane defined by the door. In this case, the code reader may be mounted in or on the opposing surface of the door frame that is parallel to a plane defined by the door when the door is closed.

The code reader of the present invention has been described herein as being disposed in a fixed building structure, such as a door frame or a window frame. However, it is to be understood that it is also possible within the scope of the invention for both the code reader and the readable code arrangement to be disposed in opposing surfaces of two movable structures. For example, the code reader and the readable code arrangement may be disposed in opposing surfaces of a pair of French doors or a pair of French windows, both of which are hinged at opposite outside edges, and which open in the middle between the two movable structures.

While this invention has been described as having an exemplary design, the present invention may be further modified within the spirit and scope of this disclosure. This application is therefore intended to cover any variations, uses, or adaptations of the invention using its general principles.

What is claimed is:

1. A method of detecting a position of a movable building structure, said method comprising the steps of:

mounting a readable code in association with one of a first surface of the movable building structure and a second surface of a second structure, the code having more than two possible values;

mounting a code reader in association with an other of the first surface and the second surface; and reading the readable code with the code reader to thereby verify that the first surface of the movable building structure is disposed in opposition to the second surface of the second structure.

2. The method of claim 1 wherein the readable code comprises a printed pattern.

3. The method of claim 1 wherein the readable code comprises a plurality of locations each having one of a presence of a respective magnetic element and an absence of the respective magnetic element.

4. The method of claim 3 wherein at least one of the locations has a presence of a respective magnetic element, and at least one of the locations has an absence of a respective magnetic element.

5. The method of claim 4 wherein the code reader comprises a plurality of magnetic field sensors, each of the sensors being mounted in association with a respective one of the locations, and each of the locations being associated with a respective one of the sensors.

6. The method of claim 1 wherein the reading step includes comparing the readable code to an expected code.

7. The method of claim 1 wherein the movable building structure comprises one of a door and a window, the second structure comprising one of a door frame and a window frame.

8. The method of claim 1 comprising the further step of periodically repeating the reading step.

9. The method of claim 1 wherein the readable code comprises a binary code.

10. A security assembly, comprising:

a first building structure at least partially defining a building opening, said first building structure having a first surface;

a movable building structure movable between a closed position in which said movable building structure covers said opening and an open position in which said movable building structure uncovers said opening, said movable building structure having a perimeter with a second surface disposed in opposition to said first surface when said movable building structure is in the closed position; and a sensor apparatus including:

an optical scanner mounted in one of said first surface and said second surface and configured to scan a pattern printed in association with an other of said first surface and said second surface and produce a signal dependent upon said pattern; and a decoder in communication with said scanner, said decoder being configured to receive the signal and verify therefrom that the movable building structure is disposed in opposition to the first building structure.

11. The security assembly of claim 10 wherein the first building structure comprises one of a door frame and a window frame.

12. The security assembly of claim 10 wherein the movable building structure comprises one of a window and a door.

13. The security assembly of claim 10 wherein the optical scanner comprises an infrared scanner, said sensor assembly further comprising a visually opaque substrate attached to the other of said first surface and said second surface such that said substrate is configured to cover the pattern, said substrate being transparent to infrared light.

14. The security assembly of claim 13 wherein the substrate is configured such that the pattern becomes unreadable as a result of said substrate being removed from the other of said first surface and said second surface.

15. The security assembly of claim 10 wherein the optical scanner is configured to scan the pattern periodically.

16. A security assembly, comprising:

a first building structure at least partially defining a building opening, said first building structure having a first surface;

a movable building structure movable between a closed position in which said movable building structure covers said opening and an open position in which said movable building structure uncovers said opening, said movable building structure having a perimeter with a second surface disposed in opposition to said first surface when said movable building structure is in the closed position; and a sensor apparatus including:

a plurality of magnetic field sensors mounted in one of said first surface and said second surface, each of said sensors being configured to sense whether a respective magnetic element is disposed opposite said sensor on an other of said first surface and said second surface, and to produce a signal indicative thereof; and a decoder device in communication with said sensors, said decoder device being configured to receive the signals and verify therefrom that the movable building structure is disposed in opposition to the first building structure.

17. The security assembly of claim 16 wherein the first building structure comprises one of a door frame and a window frame.

18. The security assembly of claim 16 wherein the signals each provide a respective bit of a binary code.

19. The security assembly of claim 18 wherein the decoder is configured to compare the received binary code to an expected binary code.

20. The security assembly of claim 16 wherein each of the magnetic field sensors is configured to continuously sense whether a respective magnetic element is disposed opposite said sensor on an other of said first surface and said second surface, and to produce a signal indicative thereof.

21. The security assembly of claim 16 further comprising a visually opaque shield attached to the other of said first surface and said second surface such that said shield is configured to cover the magnetic elements.

22. The security assembly of claim 16 further comprising at least one magnetic element, each said magnetic element being disposed opposite a respective said sensor on the other of said first surface and said second surface, wherein there are a greater number of said sensors than of said magnetic elements.

23. A security assembly, comprising:

a first object having a first surface;

a second object having a second surface, said second object being movable between a first position in which said first surface is adjacent to said second surface and a second position in which said first surface is non-adjacent to said second surface; and a sensor apparatus including:

a plurality of magnetic field sensors mounted in one of said first surface and said second surface, each of said sensors being configured to sense whether a respective magnetic element is disposed opposite said sensor on an other of said first surface and said second surface, and to produce a signal indicative thereof; and a decoder device in communication with said sensors, said decoder device being configured to receive the signals and determine therefrom whether the second object is in the first position or the second position.

24. The security assembly of claim 23 wherein said first surface is disposed in opposition to said second surface when said second object is in the first position.

25. The security assembly of claim 23 wherein the signals each provide a respective bit of a binary code.

26. The security assembly of claim 23 wherein each of the magnetic field sensors is configured to continuously sense whether a respective magnetic element is disposed opposite said sensor on an other of said first surface and said second surface, and to produce a signal indicative thereof.

27. The security assembly of claim 23 further comprising a visually opaque shield attached to the other of said first surface and said second surface such that said shield is configured to cover the magnetic elements.

* * * * *